US005485995A

United States Patent [19]

Newgarden, Jr.

[11] Patent Number: 5,485,995

[45] Date of Patent: Jan. 23, 1996

[54] ROBOT TABLE TENNIS BALL SERVER ASSEMBLY

[76] Inventor: Joseph E. Newgarden, Jr., 400 N. Belvedere, P.O. Box 959, Gallatin, Tenn. 37066

[21] Appl. No.: 223,306

[22] Filed: Apr. 4, 1994

Related U.S. Application Data

[63] Continuation of Ser. No. 959,276, Oct. 9, 1992, abandoned.

[51] Int. Cl.[6] ..... A63B 69/00

[52] U.S. Cl. ..... 273/30

[58] Field of Search ..... 273/30

[56] References Cited

U.S. PATENT DOCUMENTS

| | | | |
|---|---|---|---|
| Re. 30,703 | 8/1981 | Paulson et al. | 124/1 |
| 2,087,575 | 7/1937 | Littell et al. | 273/29 |
| 2,508,461 | 5/1950 | Lemon | 273/30 |
| 2,793,636 | 5/1957 | Cook | 124/6 |
| 3,761,085 | 9/1973 | Cook | 273/30 |
| 3,794,011 | 2/1974 | Newgarden | 124/1 |
| 3,815,907 | 6/1974 | Cook | 273/30 |
| 3,855,988 | 12/1974 | Sweeton | 124/11 |
| 3,878,827 | 4/1975 | Newgarden | 124/1 |
| 3,911,888 | 10/1975 | Horvath | 124/11 |
| 3,917,265 | 11/1975 | Schrier | 273/30 |
| 3,989,245 | 11/1976 | Augustine et al. | 273/29 |
| 3,999,754 | 12/1970 | Krzysztofiak | 273/30 |
| 4,002,336 | 1/1977 | Beaver et al. | 273/30 |
| 4,046,131 | 9/1977 | Clark et al. | 124/71 |
| 4,116,438 | 9/1978 | Berliner | 273/30 |
| 4,185,824 | 1/1980 | Natwick | 273/101 |
| 4,325,351 | 4/1982 | Yuasa | 124/78 |
| 4,559,918 | 12/1985 | Ballerin et al. | 124/78 |
| 4,844,458 | 7/1989 | Gatchel et al. | 273/30 |
| 4,854,588 | 8/1989 | Gatchel et al. | 273/30 |
| 4,917,380 | 4/1990 | Gatchel et al. | 273/30 |
| 5,009,421 | 4/1991 | Gatchel et al. | 273/30 |

FOREIGN PATENT DOCUMENTS

| | | | |
|---|---|---|---|
| 857260 | 12/1960 | Germany | 273/30 |
| 2532236 | 3/1976 | Germany . | |

*Primary Examiner*—Theatrice Brown

*Attorney, Agent, or Firm*—Polster, Lieder, Woodruff & Lucchesi

[57] ABSTRACT

A portable, low-cost robot serving assembly for serving table tennis balls includes a tray for holding a plurality of table tennis balls and a robot server removably mounted inside the tray. The robot-can be mounted to the front or rear of the tray and receive balls through a front opening positioned within the tray. The tray contains a quick release mounting assembly for mounting the assembly on a table, the mounting assembly being foldable for convenient carrying or storage. The assembly is designed such that a net assembly, ball troughs or panning head can be added if desired.

4 Claims, 5 Drawing Sheets

ROBOT TABLE TENNIS BALL SERVER ASSEMBLY

This is a continuation application of application Ser. No. 07/959,276, filed on Oct. 9, 1992 (now abandoned).

BACKGROUND OF THE INVENTION

This invention relates to a robot server assembly for serving table tennis balls, and more specifically to a robot server assembly that is portable and low cost.

Table tennis is a popular competitive and recreational sport. The object of the game is to have a player on each side of the table so that each player can serve, return and rally a table tennis ball. Often, however, a player may wish to play the game of table tennis without another player. To that end, various table tennis ball serving devices or robots have been developed. The devices serve the ball to the player so that the player can return the shot in the direction of the robot. Many of the devices known to the art, however, lack functional, useful, or effective means of capturing the ball returned by the human player and recycling the ball to the robot server.

For example, U.S. Pat. No. 2,087,575 to Littell et al. describes a device that can be employed in table tennis, for example, for ejecting light weight balls. The device includes an overhead supply means, typically in the form of an overhead hopper which is fed by a conveyor system having a series of ball carrying members mechanically mounted for movement in a continuous loop.

U.S. Pat. No. 2,508,461, to Lemon describes an apparatus for ejecting table tennis balls and employs pressurized air, as from a home vacuum cleaner, to propel and eject balls from a conduit. A gravity fed collector box is provided for introducing a ball into a lower portion of the conduit. The Lemon device provides no control on the entrance of the balls, and failure of the balls to feed properly can result in a loss of air pressure particularly as a plurality of balls are introduced into the system.

U.S. Pat. No. 3,917,265, to Schrier, is another pneumatic ball ejecting machine including pneumatic means for transporting the balls from a collection source, for loading the balls to an ejection means and for ejecting the balls. Again, maintenance of air pressure in the device is critical. Furthermore, the device does not disclose an effective means for catching the return shot and feeding it to the ejector mechanism.

U.S. Pat. No. 4,116,438 to Berliner, describes a device for throwing table tennis balls, having a mechanical throwing means including two flexible, thin throwing discs extending generally parallel with respect to each other for grasping a table tennis ball between them and ejecting it along a guide. The balls are returned to the serving disc by pneumatic means.

U.S. Pat. No. 2,793,636 to Cook, describes a fan operated device as does U.S. Pat. No. 3,911,888 to Horvath.

U.S. Pat. No. 3,989,242 to Augustine discloses a device for ejecting conventional tennis balls and also discloses an enclosure means including netting for catching served balls hit by a player.

My own U.S. Pat. No. 3,794,001 to Newgarden describes a relatively simple device for imparting variations in the amount of spin applied to a ball being served by the server. The disclosure of my patent is intended to be incorporated herein by reference.

I am also a joint inventor of U.S. Pat. Nos. 4,844,458; 4,854,588; 4,917,380; and 5,009,421 which discloses a portable table tennis serving device including a robot server and a ball capture net. This device employs the use of one collapsible net which cooperates with the robot so that returned balls are fed automatically to the robot. A folding net structure is also employed for attachment to a table tennis table and for feeding balls to a robot ball server. The single net structure includes a plurality of arms extending radially from a central member and netting suspended between the arms. The netting has a lower edge which is cooperatively connected with a trough device for receiving balls that fall from the netting. The trough is disposed to feed the balls to the robot serving device. The disclosures in the above described patents are incorporated by reference herein.

It can be seen that, for the most part, the robot serving devices of the prior art disclose ball catching mechanisms, or elaborate or mechanically complicated ball feeding devices, such a pneumatic device or conveyers which are complex and expensive. It is desirable, therefore, to have a basic, entry level server device for sequentially serving a plurality of balls to the player employing a relatively simple, inexpensive design.

SUMMARY OF THE INVENTION

It is therefore an object of the present invention to provide a simple robot server assembly containing a tray designed to hold a plurality of balls for use by the robot server mounted therein.

Another object of the invention is to provide a robot server assembly wherein the robot can be mounted within the ball tray.

A still further object of the invention is to provide a robot server assembly wherein the robot server can accept balls from the front.

Another object of the invention is to provide a robot server assembly wherein the server can receive balls from the rear.

Another object of the invention is to provide a robot server assembly employing a quick release foldable attaching means for attaching the assembly to a table.

Yet another object of the invention is to provide a robot server assembly that can be expanded to accept a net assembly, trough assembly, or panning ball ejector head.

Another object of the invention is to provide a ball server assembly of flexible operation and performance but of relatively simple and inexpensive construction.

In accordance with the invention, generally stated, a robot ball serving assembly is provided that is of simple and inexpensive construction. The assembly contains a tray which is designed to hold a plurality of balls. A robot server is removably mounted within the tray either on the back portion of the tray, so that the robot server can receive balls from the front, or mounted on the front of the tray so that the robot server can receive balls from the rear. The tray has a quick release mounting mechanism by which the assembly can be mounted to the end of the table. The mounting mechanism is hingedly attached to the tray so that the mounting mechanism can be folded upwardly and out of the way for carrying or storage. The assembly has an optional mechanized panning device which can be mounted on the top of the robot, thereby giving the robot ball panning ejection capabilities. Furthermore, the assembly is adapted for enhancement so that a ball catching net assembly and trough device can be added to the assembly if desired.

Figure 3:
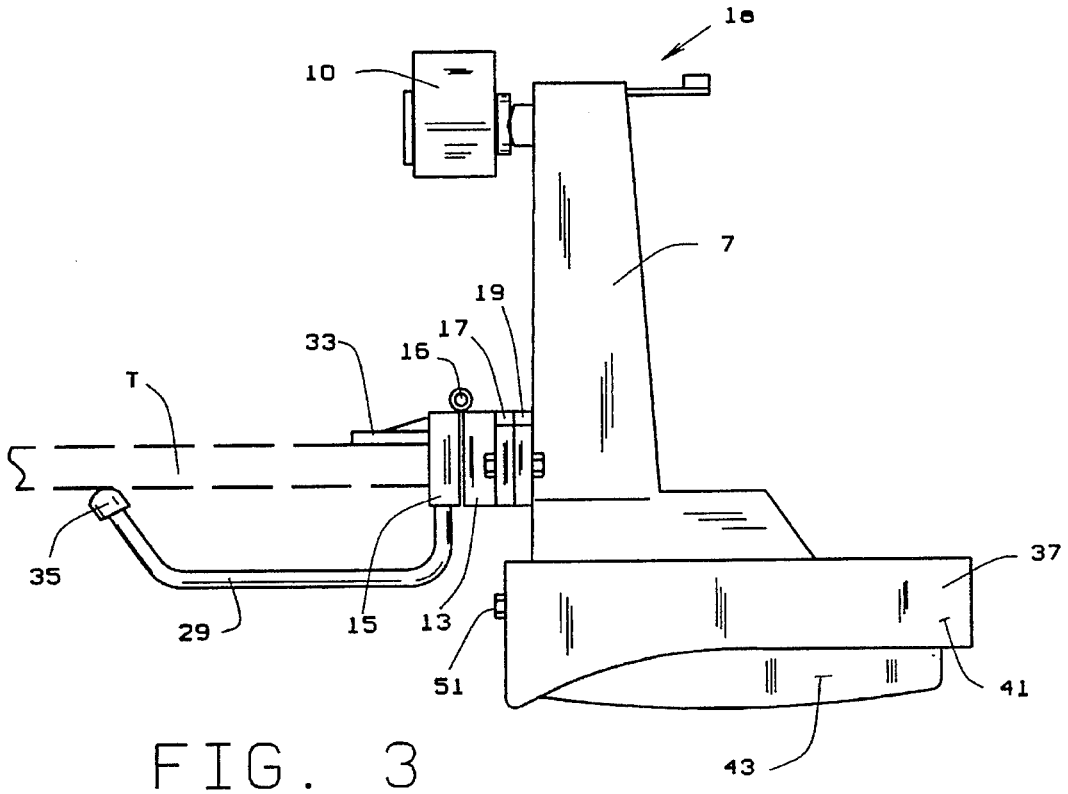
FIG. 3 is a side elevational view of the embodiment of the robot server assembly of the present invention as shown in FIG. 2 which is mounted to a table shown in phantom.
Figure 5:
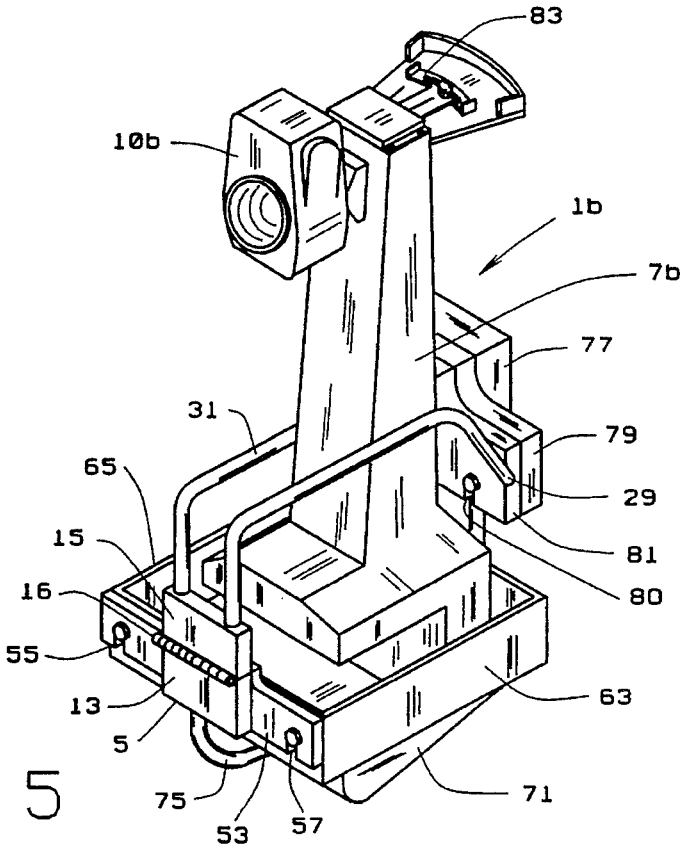
Figure 6:
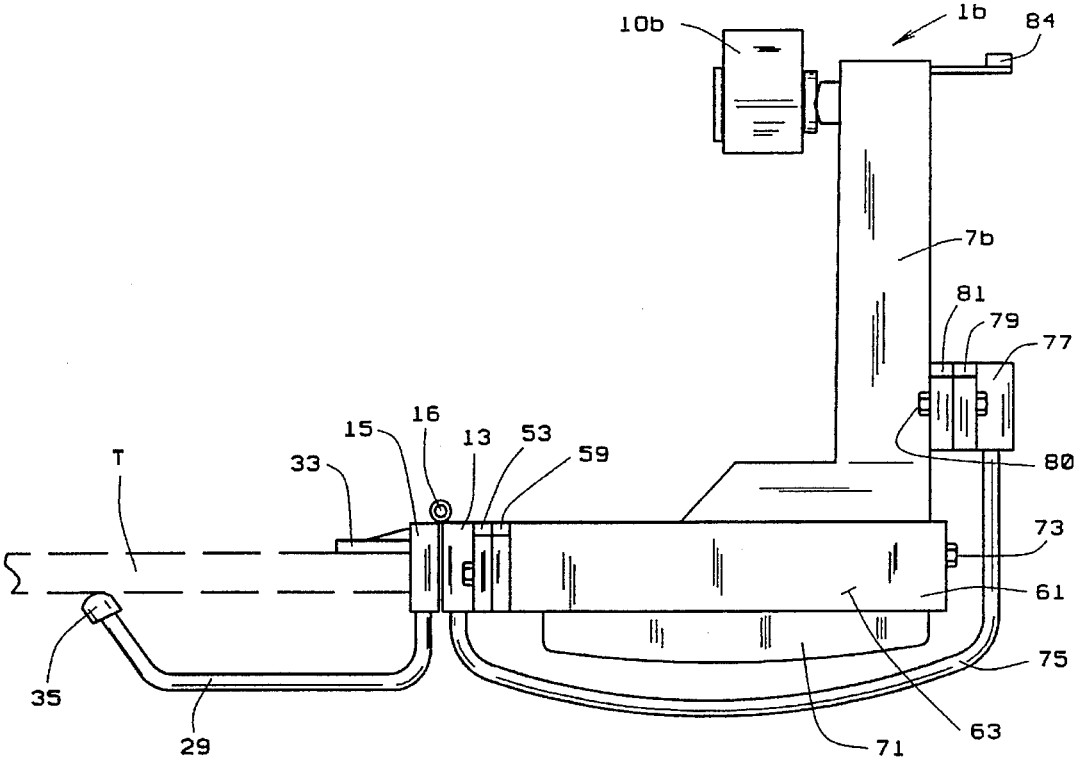
Figure 7:
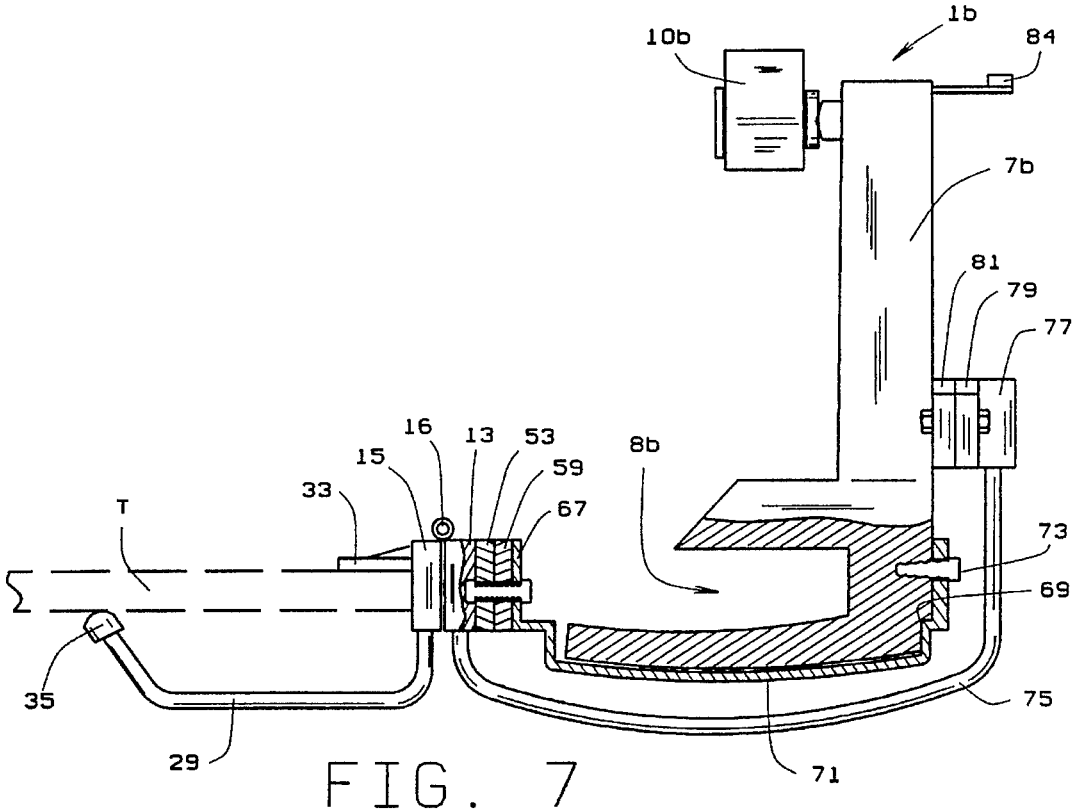
Figure 8:
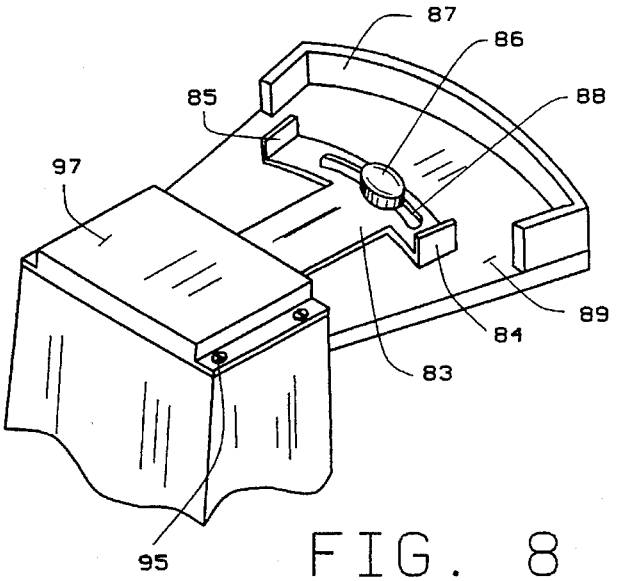
Figure 9:
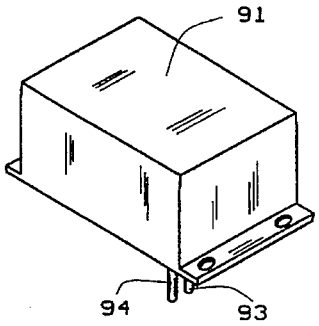
Figure 10:
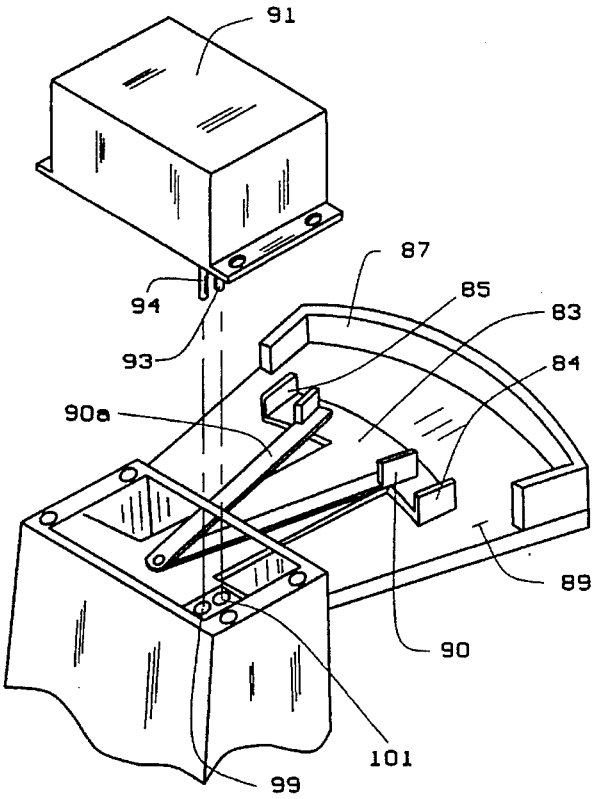
Figure 11:
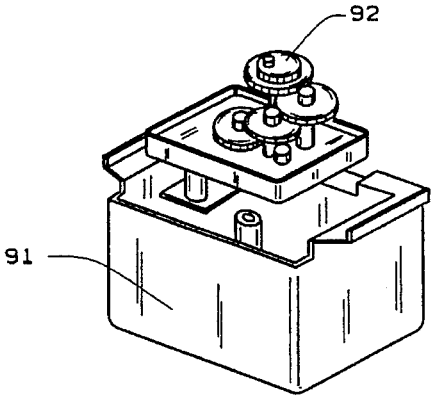

FIG. is a 4 is a partial cross-sectional view of the robot server assembly as shown in FIG. 3;

FIG. 5 is a perspective view of an alternative preferred embodiment of the robot server of the present invention;

FIG. 6 is a side elevational view of the embodiment of the robot server assembly of the present invention as shown in FIG. 5 which is mounted to a table shown in phantom;

FIG. 7 is a partial cross-sectional view of the robot server assembly as shown in FIG. 6;

FIG. 8 is a partial perspective view of the manual panning assembly of the present invention;

FIG. 9 is a perspective view of the optional panning head of the present invention;

FIG. 10 is an exploded view of the removable panning head and panning mount assembly of the present invention; and FIG. 11 is an exploded, bottom plan of the optional panning head of the present invention.

DESCRIPTION OF THE PREFERRED EMBODIMENT

Figure 1:
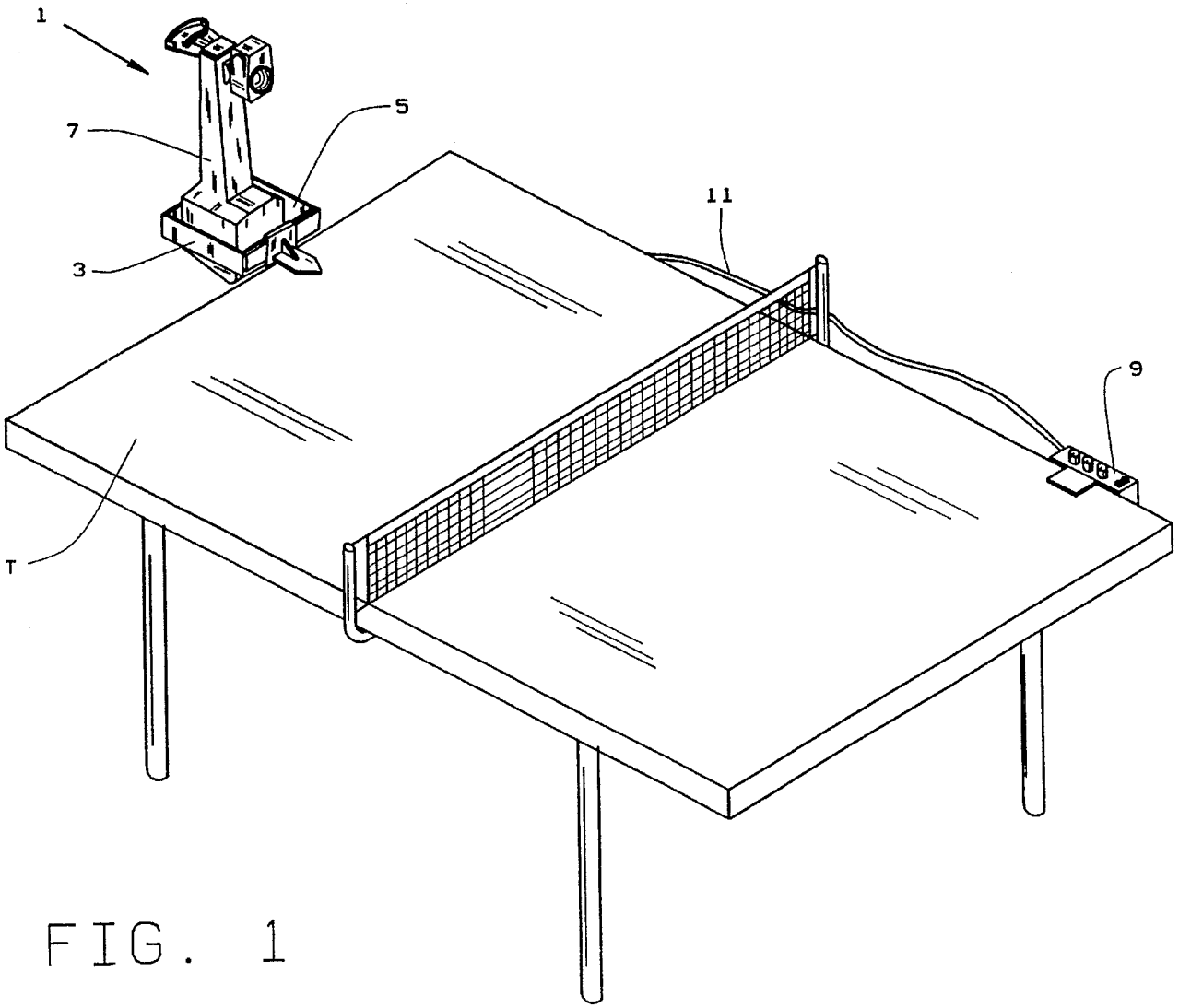
FIG. 1 is a perspective view of a robot server assembly of the present invention mounted on a table to show environment.

FIG. 1 illustrates the robot server assembly of the present invention, shown generally at 1, which is mounted on a table tennis table T to demonstrate environment. The assembly contains a tray 3 designed to hold a plurality of table tennis balls. Tray 3 is removably attached to table T by a mounting assembly shown generally at 5. Robot server 7 is mounted to the tray, the function and operation of robot 7 being described in my U.S. Pat. Nos. 4,854,588 and 4,917,380, for example, which are hereby incorporated by reference.

The assembly employs a remote control unit 9 placed at the opposite end of the table from the robot assembly so as to be easily accessible to the player. Unit 9 is operatively connected to robot 7 by wire 11 and functions to control the operations of robot 7 as well as the optional, removable panning device, as will be described hereinafter such panning device has also been described in detail in the aforementioned patents incorporated herein by reference.

A more detailed description of each of the individual components of assembly 1 will now follow.

Figure 2:
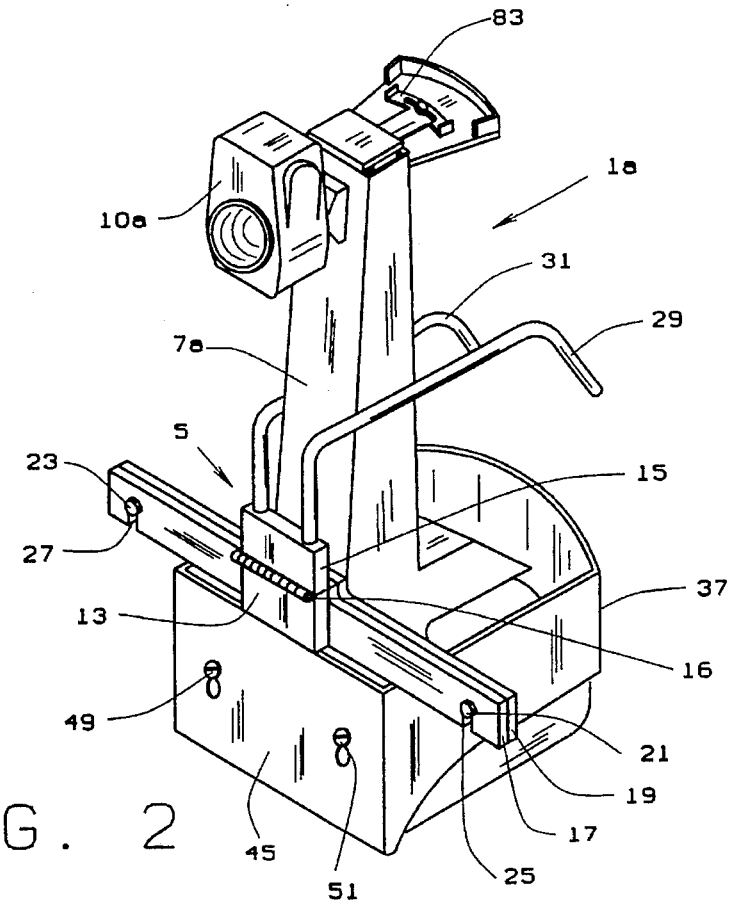
FIG. 2 is a perspective view of one preferred embodiment of the robot server assembly of the present invention.
Figure 4:
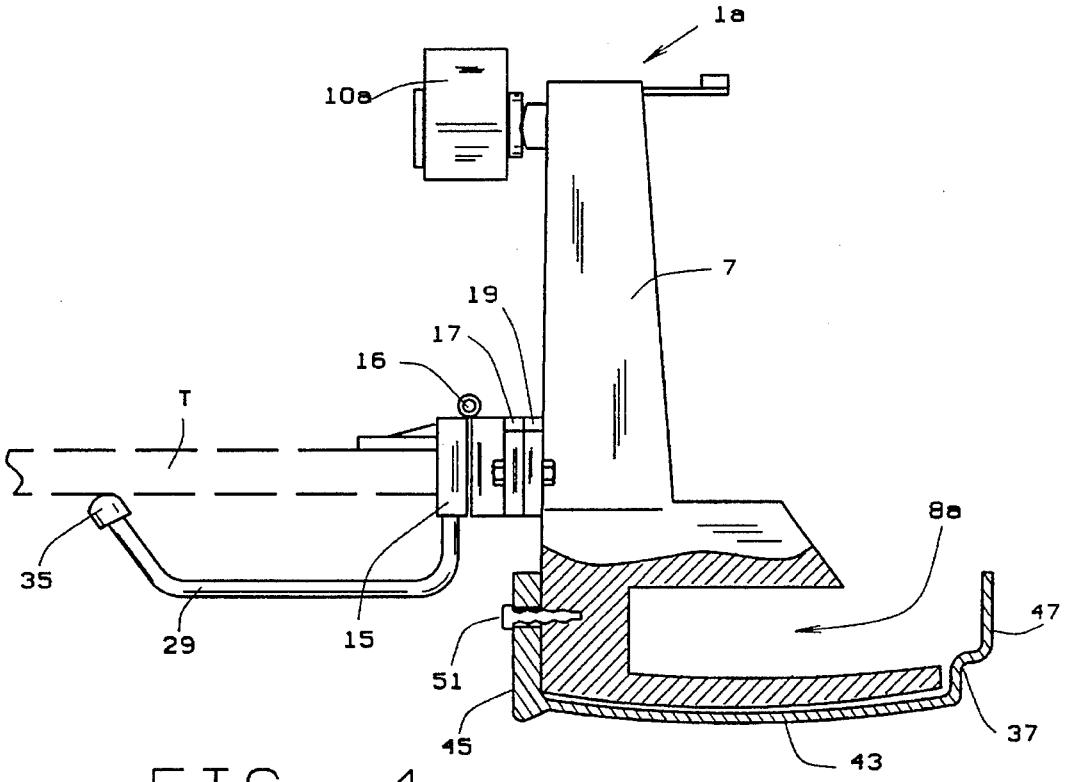

FIGS. 2–4 illustrate one preferred embodiment of the present invention shown generally at 1*a*. The assembly contains a robot 7*a* having a mounting assembly shown generally at 5 attached to robot 7*a* for mounting the assembly to a table. Assembly 5 is a quick release mounting mechanism containing a lower plate 13 hingedly connected to upper plate 15 by hinge 16 so that assembly 5 can be pivoted up and out of the way for storage or carrying as shown in FIG. 2. Plate 13 is suitably attached to a first stabilizer bar 17 by attachment means (not shown) such as screws or bolts. First stabilizer bar 17 is attached to second stabilizer bar 19 by nut and bolt assemblies 21 and 23 through slots 25 and 27, respectively. Bolt assemblies 21 and 23 can be loosened or removed so that bar 17 can be removed from bar 19. Bar 19 can then be mounted directly to the end of the table by using proper screws or bolts, thereby eliminating the quick release mounting assembly 5, if desired.

Assembly 5 contains lower, splayed brace arms 29 and 31 and top brace member 33. As illustrated in FIGS. 3 and 4, splayed arms 29 and 31 extend outwardly from plate 15 well beyond the length of top brace 33. Top brace 33 rests on the top of the table while arms 29 and 31 are formed in a wide V-shape so that the tip of each arm, as shown at 35, will reach out and abut the bottom of table T. The assembly rests on table T secured under its own weight. The entire robot server assembly can be quickly removed from table T by grasping the assembly and tilting it slightly upward and forward, lifting member 33 from table T and then sliding arms 29 and 31 free from under table T.

Turning now to the ball container component of the embodiment as shown in FIGS. 2–4, assembly la contains a tray 37, (shown as 3 in FIG. 1). Tray 37 is of a generally rectangular shape having vertical side walls as at 41, a lower pan 43 formed as a bottom, as well as front and rear vertical walls 45 and 47. Tray 37 is constructed from a suitable material, such as high impact plastic or the like, and is attached to robot 7 through front wall 45 by screws 49 and 51 or other appropriate attachment means. It should be noted that tray 37 can be constructed in any convenient or functional configuration and of such dimensions that will allow it to house the lower portion of robot 7 along with a plurality of table tennis balls (not shown).

As shown in FIG. 4, tray 37 is mounted to the lower portion of robot 7. Robot 7 has a receiving means or opening 8*a* that is designed to receive table tennis balls from the plurality of balls placed in tray 37. The balls are fed up through robot 7 and expelled through expelling means 10*a* onto the playing surface of table T. The bottom of pan 43 slopes gently to opening 8*a* so that balls will roll into opening 8*a* and provide a supply of balls to be expelled from the device. It should also be noted that tray 37 can be removed by loosening attachment means 49 and 51 so that tray 37 can be replaced by a more elaborate container, capture net, and trough assembly (not shown) that is designed to catch the balls hit back at the robot and feed them to receiving means 8*a*. The more elaborate container capture net and trough assembly are shown in my patent application entitled Robot Table Tennis Net and Server Assembly filed on Oct. 9, 1992, U.S. Ser. No. 07/959,276, now abandoned.

FIGS. 5–7 illustrate another preferred embodiment of the robot server assembly of the present invention shown generally at 1*b*. Assembly 1*b* contains a robot 7*b* constructed so as to have a ball receiving means 8*b* facing forward toward table T (FIG. 7) as will be explained hereinafter.

In this embodiment, assembly 1*b* has mounting means 5, containing plates 13 and 15, hinge 16, table supporting arms 29 and 31, as well as top member 33 which function relative to table T just as previously described in reference to mounting means 5 employed on the assembly 1*a*. However, in assembly 1*b*, the quick release mounting means is attached directly to the ball container, as will now be explained.

Plate 13 is attached to mounting bar 53 by suitable attaching means such as screws or bolts (not shown) through slots 55 and 57. Slots 55 and 57 function analogously to slots 25 and 27 in assembly 1*a* so as to allow removal of mounting means 5. Mounting bar 53 is secured to a second mounting bar 59 attached to front wall 67 of tray 61 (shown as 3 in FIG. 1). Tray 61 is generally rectangular in shape having vertical side walls 63 and 65 a vertical front walls 67, and a vertical rear wall 69. A bottom wall or pan 71 is formed as the bottom of tray 61 and is designed to house ball receiving means 8*b* of robot server 7*b*, as well as a plurality of balls. Pan 71 slopes toward ball receiving means 8*b* so that balls can roll into receiving means 8*b* to be expelled onto the table through expelling means 10*b*. It should be noted at this point that tray 61 can be formed of any appropriate material such as high impact plastic or the like and can be of variable dimensions and configurations to accommodate robot 7 and a plurality of balls as may be desired.

Robot server 7*b* is attached to back or rear wall 69 with appropriate means such as screw 73. Robot server 7*b* is further stabilized by securing rod 75 which extends from bracket assembly 77 in a broad U-shape under pan 71 up to plate 13. Securing rod 75 functions to keep the assembly in the proper position relative to table T and to prevent the tray and robot portions of the assembly from sagging or bending below the plane of table T.

Mounting bracket 77 is attached to a first bracket brace 79 which is removably attached as at 80 to second bracket brace 81 so that the entire assembly of brace 79, bracket 77, rod 75, as well as the components of mounting assembly 5, can be removed, if so desired. This enables the assembly to be modified by the addition of an optional capture net assembly (not shown), as in my aforementioned patent application.

In use, both robot server assembly 1*a* and 1*b* receive balls from the bottom through receiving means 8*a* and 8*b*, respectively, and then expel the balls from the top through expelling means 10*a* and 10*b* respectively. The side-to-side trajectory of a ball expelled from the expelling means is changed by aiming the expelling means at different sites on the playing surface. FIG. 8 best illustrates the aiming mechanism employed on both illustrative embodiments of the present invention.

Lever 83, which is cooperatively connected to expelling means 10*a* or 10*b* can be grasped by the player by placing a thumb and forefinger against wings 84 and 85. By shifting lever 83 back and forth, the player can position side-to-side or panning movement of expelling means 10*a* or 10*b*. Set screw 86 is loosened to permit lever 83 to be shifted back and forth along groove 88. When the desired position is reached, the user tightens set screw 86 against the edges of groove 88 to hold lever 83 and the expelling means in position. Lever guard 87 extending vertically up from lever gauge surface 89 is designed to prevent lever wings 84 and 85 from becoming entangled in a capture net (not shown) when the optional capture net is mounted on the assembly, as previously explained. Lever gauge surface 89 can have a gauge decal illustrating the movement of lever 83 and thereby the degree of lateral movement of expelling means 10*a* or 10*b*.

FIGS. 9–11 illustrate an optional, automatic panning head shown generally at 91. Panning head 91 contains plug contacts 93 and 94 and can be operated by a player through remote unit 9 (FIG. 1). Cover plate screws 95 (FIG. 8) can be removed and allowing cover plate 97 to be removed so that control levers 90, 90*a* and panning head 91 can be attached as shown in FIG. 10. Plug contacts 93 and 94 are inserted into receptacle holes 99 and 101 to complete the electrical contact with control box 9 (FIG. 1). Panning head 91 can be controlled by the player so that it automatically moves lever 83 to change the side-to-side position of the ball expeller.

FIG. 11 illustrates the working mechanism of panning head 91. When head 91 is attached and electrically connected as described above, gear 92 is positioned between levers 90 and 90*a*. As gear 92 rotates, it alternately engages levers 90 and 90*a* so as to move the levers back and forth and thus automatically pan the ball expelling means.

Numerous variations, within the scope of the appended claims, will be apparent to those skilled in the art in light of the foregoing description and accompanying drawings.

For example, I envision that robot assembly 1*a* or 1*b* can be sold in the series of steps, which will reduce its initial low cost. A panning head, extendable trough and capture nets may be added as desired, as shown in my prior patents and aforementioned patent application. The design and aesthetic appearence of robot assemblies 1*a* and 1*b* may also be varied. For example, the size, configuration, and construction of the ball container trays can be varied without departing from the scope of the invention. Furthermore, the configuration and construction of the quick release attachment means can be varied without departing from the scope of the invention. The various described descriptions and illustrations are merely illustrative and not to be interpreted in a limiting sense.

Having thus described the invention, what is claimed and desired to be secured by Letters Patent is:

1. A robot server assembly mounted to a table tennis table for collecting and serving table tennis balls to a user comprising:

a tray having a bottom wall, peripherally connected side walls, a front wall adjacent said table tennis table and a rear wall opposed to and spaced from said from wall integral to and extending upwardly from the bottom wall for containing a plurality of table tennis balls;

a table tennis ball robot server removably mounted to said front wall, said robot server having lower table tennis ball receiving means positioned within said tray and located in proximity to the bottom wall of said tray for receiving table tennis balls contained within said tray; and mounting means for removably mounting said robot server and its attached tray to one end of a table tennis table, said mounting means being hingedly attached to and extending outwardly from a front side of said robot server, and said mounting means having support arms moveable about a hinge for positioning said mounting means in an extended position for engaging said table tennis table or a folded position adjacent said robot server to facilitate carrying and storage of said robot server assembly.

2. The robot server assembly as defined in claim 1 wherein said tray can be removed and a net and trough assembly mounted to said robot server.

3. The robot server assembly as defined in claim 2 wherein said robot server has a detachable manual panning head for replacement by a motor driven panning head.

4. The robot server assembly as defined in claim 3 wherein said mounting means further includes quick release mounting means to facilitate mounting and removal from said table tennis table, said quick release mounting means having a top member for engaging the top surface of the table tennis table and opposed first and second arms in splayed relationship to engage the underside of the tennis table.

* * * * *